US012799847B2

(12) United States Patent
Lupien et al.

(10) Patent No.: US 12,799,847 B2
(45) Date of Patent: Nov. 17, 2026

(54) RECIRCULATION VALVE

(71) Applicant: TIER 1 ENERGY SOLUTIONS, INC., Edmonton (CA)

(72) Inventors: Daniel P. Lupien, Edmonton (CA); Jeffrey Golinowski, Sherwood Park (CA); Laren Cruise, Edmonton (CA)

(73) Assignee: Tier 1 Energy Solutions, Inc., Edmonton (CA)

( * ) Notice: Subject to any disclaimer, the term of this patent is extended or adjusted under 35 U.S.C. 154(b) by 0 days.

(21) Appl. No.: 19/177,125

(22) Filed: Apr. 11, 2025

(65) Prior Publication Data

US 2025/0327372 A1 Oct. 23, 2025

Related U.S. Application Data

(60) Provisional application No. 63/637,695, filed on Apr. 23, 2024.

(51) Int. Cl.
*E21B 34/12* (2006.01)
*E21B 34/10* (2006.01)

(52) U.S. Cl.
CPC ..... *E21B 34/10* (2013.01); *E21B 2200/06* (2020.05)

(58) Field of Classification Search
CPC ..... E21B 31/10; E21B 34/102; E21B 34/12; E21B 2200/06
See application file for complete search history.

(56) References Cited

U.S. PATENT DOCUMENTS

| | | | | |
|---|---|---|---|---|
| 2,064,272 A | | 12/1936 | Scott | |
| 3,094,306 A | * | 6/1963 | Conrad | E21B 34/12 251/297 |
| 3,193,016 A | * | 7/1965 | Knox | E21B 34/10 251/324 |
| 3,583,481 A | | 6/1971 | Vernotzy | |
| 3,653,439 A | | 4/1972 | Kisling | |
| 4,072,166 A | * | 2/1978 | Tiraspolsky | F16K 17/044 137/496 |
| 4,258,793 A | * | 3/1981 | McGraw | E21B 34/06 137/71 |
| 4,291,723 A | | 9/1981 | Beimgraben et al. | |
| 4,354,554 A | | 10/1982 | Calhoun et al. | |
| 4,494,608 A | * | 1/1985 | Williams | E21B 23/08 166/322 |

(Continued)

FOREIGN PATENT DOCUMENTS

| | | |
|---|---|---|
| CA | 2623902 A1 | 9/2009 |
| CA | 2657160 A1 | 9/2009 |
| EP | 1000220 B1 | 4/2002 |

*Primary Examiner* — Kenneth L Thompson
(74) *Attorney, Agent, or Firm* — Bennett Jones LLP

(57) ABSTRACT

A downhole recirculation valve includes a flow mandrel and a pressure actuated concentric sliding sleeve which opens and closes a fluid recirculation port. The sleeve and mandrel are releasably locked together with a collet. A return spring provides a biasing force to maintain the sleeve in a closed position. The valve may be repeated opened and closed with pressure. Also disclosed is a method of circulating a treatment fluid downhole through a tubing string with a recirculation valve configured to be actuated by fluid pressure within the tubing string, and having an opening force requirement and a maintenance force requirement which is less than the opening force requirement.

10 Claims, 5 Drawing Sheets

(56) References Cited

U.S. PATENT DOCUMENTS

| | | | | |
|---|---|---|---|---|
| 4,832,126 | A | 5/1989 | Roche | |
| 5,141,056 | A * | 8/1992 | Tailby | E21B 34/102 166/321 |
| 5,372,193 | A * | 12/1994 | French | E21B 34/10 166/113 |
| 6,220,357 | B1 * | 4/2001 | Carmichael | E21B 43/088 166/227 |
| 8,646,532 | B2 * | 2/2014 | Xu | E21B 34/10 166/321 |
| 9,580,993 | B2 * | 2/2017 | Aitken | E21B 43/084 |
| 2002/0017384 | A1 | 2/2002 | Ostocke et al. | |
| 2004/0084190 | A1 | 5/2004 | Hill et al. | |
| 2006/0011354 | A1 | 1/2006 | Logiudice et al. | |
| 2008/0164035 | A1 | 7/2008 | Bolding et al. | |

* cited by examiner

RECIRCULATION VALVE

CROSS-REFERENCE TO RELATED PATENT APPLICATION

This application claims the priority benefit of U.S. Provisional Patent Application No. 63/637,695, titled "RECIRCULATION VALVE", filed on Apr. 23, 2024, the entire contents of which are incorporated herein by reference.

BACKGROUND

Chemical injection methods for the reduction of wax build up in production tubing results in use of service equipment to intervene and circulate a treatment fluid through the production tubing. This is a costly and time-consuming process that requires well production to be stopped. This process needs to be repeated continuously or on a regular basis to prevent production issues related to wax build up.

There is a need in the art for methods and systems which permit forward circulation of a treatment fluid down the tubing and up the annulus, without unseating a downhole pump.

SUMMARY

It is to be understood that both the following general description and the following detailed description are exemplary and explanatory only and are not restrictive. Disclosed herein are methods and systems for circulating an injected chemical treatment in a wellbore, typically to reduce wax buildup.

In one aspect, disclosed is a recirculation valve comprising:

a. a flow mandrel defining a central flow passage, at least one flow port and at least one actuation port;
b. a concentric sleeve slidingly and sealingly disposed around the flow mandrel;
c. an actuation chamber defined by and between the flow mandrel and the concentric sleeve, the actuation chamber in fluid communication with the central flow passage through the flow mandrel at least one actuation port;
d. a collet lock disposed between the sleeve and the flow mandrel for releasably attaching the sleeve to the flow mandrel;
e. wherein the sleeve is moveable between a closed position, wherein the flow mandrel flow port is covered by the sleeve, and an open position wherein the sleeve does not close the flow mandrel flow port; and
f. a return spring for biasing the sleeve into its closed position.

In some embodiments, the collet lock comprises a plurality of collet fingers, wherein the collet lock is attached to either the sleeve or the mandrel and the collet fingers are releasably engaged in a groove formed in the sleeve or the mandrel. Preferably, the collet lock is attached to the sleeve and comprises collet fingers having an enlarged upper end which engages the groove formed on the flow mandrel. Preferably, the collet fingers are disposed within the actuation chamber.

Preferably, a stop ring is disposed on the flow mandrel to limit downward travel of the sleeve to its open position.

The collet lock is configured to release at a specified force, which together with the return spring force, is the force which must be overcome to open the valve. In one embodiment, the opening force is provided by greater than about 200 psi, and preferably about 800 to about 1000 psi. Once open, a maintenance pressure is required to maintain the sleeve in its open position, which is enough to compress the return spring, which may be less than about 200 psi, and preferably in the range of about 50 psi to 100 psi.

In another aspect, disclosed is a method of circulating a treatment fluid downhole through a tubing string, comprising the steps of:

(a) installing a recirculation valve configured to be actuated by fluid pressure within the tubing string, and having an opening force requirement and a maintenance force requirement, which is less than the opening force requirement;
(b) opening the valve by pressuring up the tubing string to above the opening force requirement; and
(c) introducing the treatment fluid into the tubing string at a pressure above the maintenance requirement, such that the treatment fluid passes through the recirculation valve.

In some embodiments, the treatment fluid may comprise a wax inhibitor, an asphaltene inhibitor, a scale or corrosion inhibitor, and/or a demulsifier.

In some embodiments, the opening force requirement is provided by fluid pressure greater than about 200 psi, preferably in the range of about 800 psi to about 1000 psi.

In some embodiments, the maintenance force is provided by fluid pressure of less than about 200 psi, preferably in the range of about 50 psi to about 100 psi.

Additional advantages will be set forth in part in the description which follows or may be learned by practice. The advantages will be realized and attained by means of the elements and combinations particularly pointed out in the appended claims. In some embodiments, the invention comprises any functional combination of features described below or shown in the Figures.

BRIEF DESCRIPTION OF THE DRAWINGS

The accompanying drawings, which are incorporated in and constitute a part of the present description serve to explain the principles of the methods and systems described herein.

DETAILED DESCRIPTION

Figure 1A:
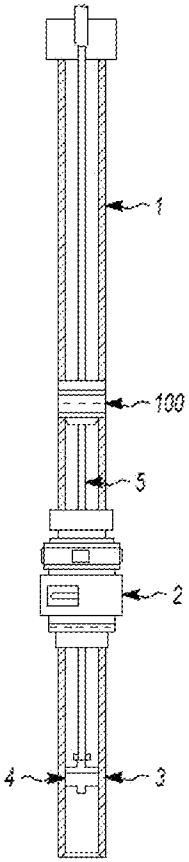
FIG. 1A shows a bottom hole assembly with a recirculation valve.

As used in the specification and the appended claims, the singular forms "a," "an," and "the" include plural referents unless the context clearly dictates otherwise. Ranges may be expressed herein as from "about" one particular value, and/or to "about" another particular value. When such a range is expressed, another configuration includes from the one particular value and/or to the other particular value, and every value in between. Similarly, when values are expressed as approximations, by use of the antecedent "about," it will be understood that the particular value forms another configuration. It will be further understood that the endpoints of each of the ranges are significant both in relation to the other endpoint, and independently of the other endpoint.

"Optional" or "optionally" means that the subsequently described event or circumstance may or may not occur, and that the description includes cases where said event or circumstance occurs and cases where it does not.

Throughout the description and claims of this specification, the word "comprise" and variations of the word, such as "comprising" and "comprises," means "including but not limited to," and is not intended to exclude, for example, other components, integers or steps. "Exemplary" means "an example of" and is not intended to convey an indication of a preferred or ideal configuration. "Such as" is not used in a restrictive sense, but for explanatory purposes.

It is understood that when combinations, subsets, interactions, groups, etc. of components are described that, while specific reference of each various individual and collective combinations and permutations of these may not be explicitly described, each is specifically contemplated and described herein. This applies to all parts of this application including, but not limited to, steps in described methods. Thus, if there are a variety of additional steps that may be performed it is understood that each of these additional steps may be performed with any specific configuration or combination of configurations of the described methods.

In describing a downhole tool or assembly, "uphole" or "proximal" is the direction towards the surface, while the "downhole" or "distal" direction is the opposite direction, towards the bottom or end of the wellbore. Conventionally, when an elongated device is shown with its main longitudinal axis shown horizontally in a drawing, the uphole end is on the left hand side. The terms "radial", "lateral" or "transverse" are used in relation to a direction or plane which intersects the main longitudinal axis, preferably at a perpendicular angle. Directional prepositions refer to the device either as it is oriented and appears in the drawings, or with reference to the uphole and downhole directions, and are used for convenience only; they are not intended to be limiting or to imply that the device has to be used or positioned in any particular orientation, except where noted. Conventional components of the invention are elements that are well-known in the prior art and will not be discussed in detail for this disclosure.

Provided herein are embodiments of a pressure-activated recirculation valve 100, also known in the industry as a tubing drain. In some embodiments, the recirculation valve 100 is installed as part of the bottom hole assembly, which comprises an anchor catcher 2, a pump seating nipple 3, and a bottom hole reciprocating pump 4 connected to a drill rod string 5. The recirculation valve 100 forms part of the production tubing string 1, and the drill rod string 5 passes through the recirculation valve 100.

The recirculation valve 100 generally defines a flow through bore and comprises a bottom sub 10 having a lower pin end 101 and a flow mandrel 12 having an upper box end 102. The lower pin end 101 and the upper box end 102 configured to connect within the production tubing string, such as by threaded connections as is well known in the art.

Figure 1B:
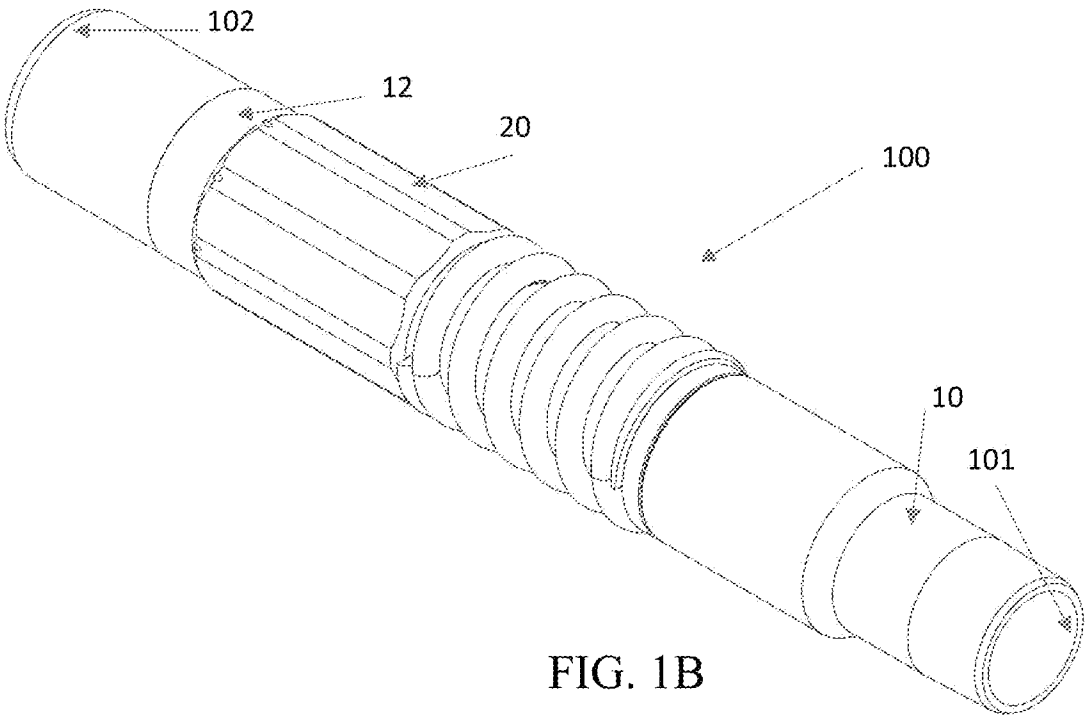
FIG. 1B shows a pictorial view of one embodiment of the circulation valve.
Figure 2B:
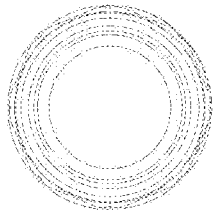
FIG. 2B is a transverse cross section of the embodiment of FIG. 1.
Figure 2A:
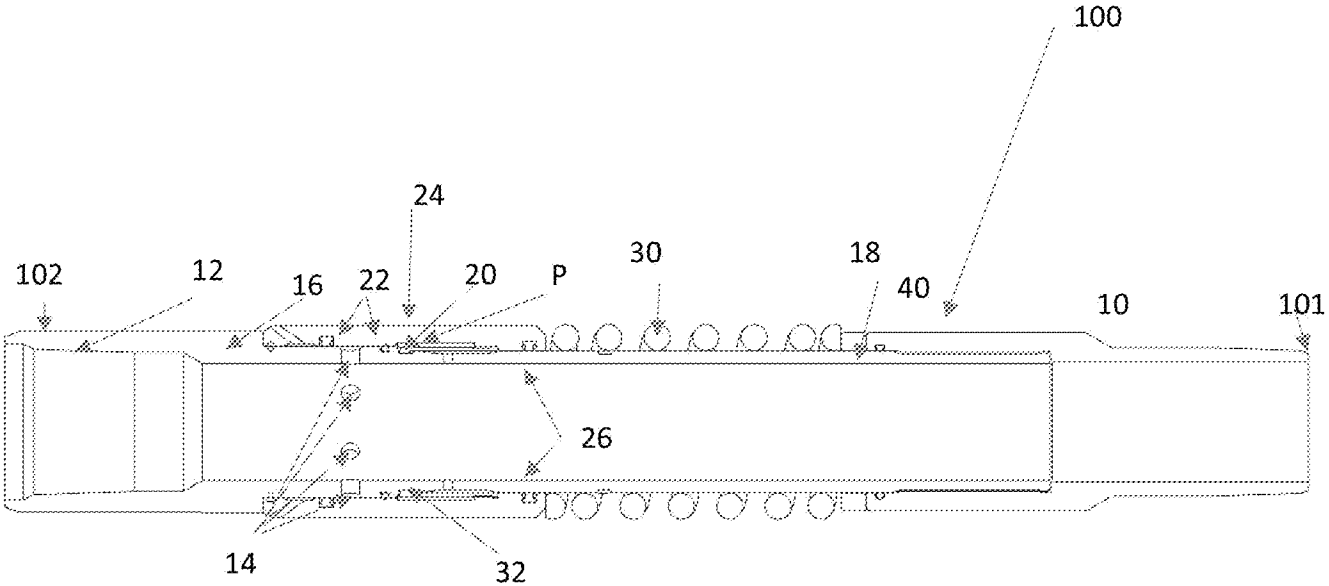
FIG. 2A is a longitudinal cross-section of the embodiment of FIG. 1, showing the valve in an open position.

A sliding sleeve 20 presents an enlarged outside diameter, and preferably has a transverse cross-section shape which is non-circular. In one embodiment, the transverse cross-section shape is substantially hexagonal, as may be seen in FIGS. 1B and 2B. The non-circular outer surface provides a larger annular volume for fluid to pass around the valve 100 to prevent or reduce choking in the annular space between the valve 100 and the casing inside diameter.

The flow mandrel 12 defines a central flow passage and a plurality of radial flow ports 14 which provide fluid communication from the central flow passage to an exterior volume. The flow ports 14 are defined in an upper portion 16 of the flow mandrel, which has a greater outside diameter (OD) than a lower stem 18 which extends downwards and inserts into and is attached to the bottom sub 10.

The flow ports 14 are closed when covered by the sliding sleeve 20, and open when the sliding sleeve 20 shifts downwards, which is actuated by a pressure actuation chamber P defined between the sleeve 20, flow mandrel stem 18, below a shoulder 24 defined by the flow mandrel upper portion.

The sliding sleeve 20 has an upper portion which has an inside diameter (ID) which closely matches the OD of the upper portion 16 of the flow mandrel. O-ring seals 22 are disposed above and below flow ports 14 between the sliding sleeve 20 and the upper portion 16 of the flow mandrel. The sleeve 20 has a lower portion which surrounds and is sealed to the flow mandrel stem 18.

Figure 2C:
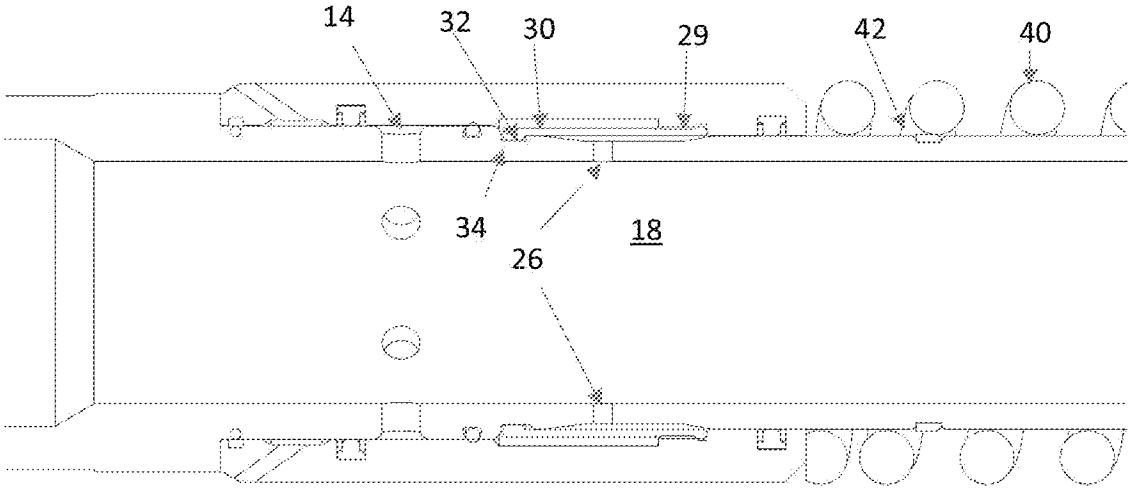
FIG. 2C is a detailed view of a portion of FIG. 2A.

The sleeve 20 and flow mandrel 12 are releasably locked together by a collet 29 having a plurality of collet fingers 30. The lower end of the collet 29 engages an inner surface of the sleeve and moves in unison with the sleeve 20. The collet comprises a plurality of collect fingers having an upper end which has an enlarged portion 32, which releasably engages a radial groove 34 formed in the flow mandrel stem 18, as shown in FIG. 2C. The collet 29 lock also prevents early movement or chattering of the sliding sleeve 20. Chattering can reduce the life of the seals on the sleeve thus causing premature failure of the valve.

In alternative embodiments (not shown), the collet 29 may be affixed to the flow mandrel 12 while the collet fingers releasably engage the sliding sleeve.

A return spring 40 is provided which biases the sleeve 20 in its raised, closed position where the collet 29 is locked to the mandrel. The collet fingers 30 and their engagement to the flow mandrel stem 18 are configured to release with a specified force which compresses the spring 40, thereby urging the sleeve 20 to slide downwards relative to the flow mandrel 12.

Figure 3:
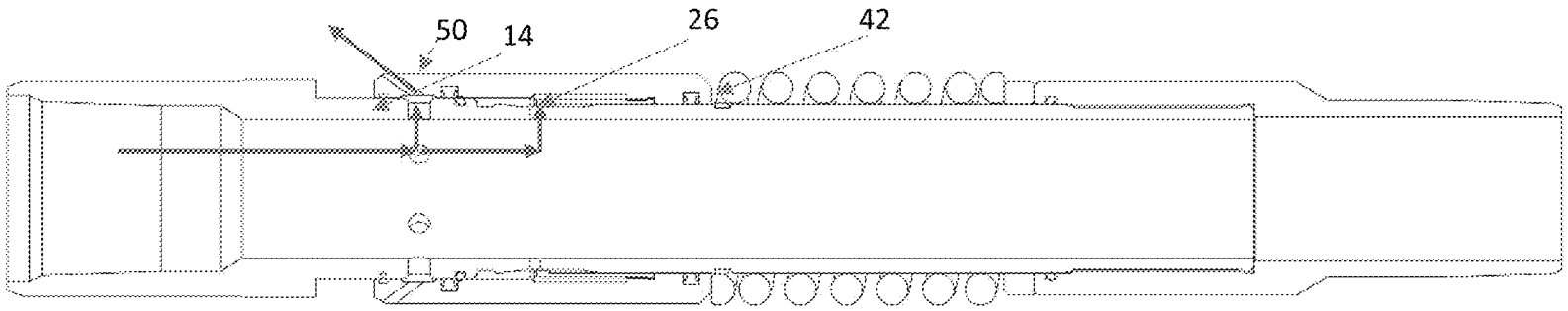
FIG. 3 is a longitudinal cross-section of the embodiment of FIG. 1, showing the valve in an closed position.

Actuation ports 26 are defined by the flow mandrel, which transmit tubing pressure from the internal bore into the actuation chamber P. When the pressure in chamber P exerts enough force to compress the return spring 40 and to release the collet fingers 32, the sleeve 20 will slide downwards along the flow mandrel 12 towards its open position, as may be seen in FIG. 3. Downward travel of the sleeve 20 is stopped by a stop ring 42 disposed on the exterior of the flow mandrel 12.

When in the open position, the flow ports 14 are aligned with openings 50 in the sleeve 20, permitting fluid flow down within the tubing (not shown) to circulate up the annulus. The spring is being compressed by the downward movement of the sleeve and requires a minimum pressure within the pressure chamber P to remain open. The sleeve 20 has bottomed out on the stop ring 42, indicating the sleeve is fully open.

In one embodiment, the opening force is provided by a pressure greater than about 200 psi, and preferably about 800 to about 1000 psi, which is sufficient to release the collet fingers 30 and compress the spring 40. All pressures described herein are surface measured pressure, and does not the hydrostatic head pressure of fluid in the well. The hydrostatic head pressure must be accounted for, and thus the depth of the well is a factor when designing the required collet opening force and the spring strength.

A greater opening force may be provided with a stronger spring and with stiffer collet finger 30 construction. Once open, the collet 29 and fingers 30 float on the mandrel 12, and only sufficient pressure to compress the return spring is required to maintain the sleeve in its open position, which may be significantly lower than the opening force. The spring strength can be chosen to keep the valve open even at low pumping pressure or rate; this can be required as the pumping unit used for chemical injection is often a low-rate or low-pressure pumper. Adjustable shims (not shown) can be added or removed to tailor the spring resistance to the specific wellbore.

Once fluid pumping pressure is reduced to below the spring strength, the spring will urge the sleeve to its closed position. As will be apparent to one skilled in the art, the recirculation valve 100 is responsive to pressure and may be opened and closed an unlimited number of times.

While specific configurations have been described, it is not intended that the scope be limited to the particular configurations set forth, as the configurations herein are intended in all respects to be possible configurations rather than restrictive. Unless otherwise expressly stated, it is in no way intended that any method set forth herein be construed as requiring that its steps be performed in a specific order. Accordingly, where a method claim does not actually recite an order to be followed by its steps or it is not otherwise specifically stated in the claims or descriptions that the steps are to be limited to a specific order, it is in no way intended that an order be inferred, in any respect. This holds for any possible non-express basis for interpretation, including: matters of logic with respect to arrangement of steps or operational flow; plain meaning derived from grammatical organization or punctuation; the number or type of configurations described in the specification.

It will be apparent to those skilled in the art that various modifications and variations may be made without departing from the scope or spirit. Other configurations will be apparent to those skilled in the art from consideration of the specification and practice described herein. It is intended that the specification and described configurations be considered as exemplary only, with a true scope and spirit being indicated by the following claims.

The invention claimed is:

1. A downhole recirculation valve comprising:

a. a flow mandrel defining a central flow passage, at least one flow port and at least one actuation port;

b. a concentric sleeve slidingly and sealingly disposed around the flow mandrel;

c. an actuation chamber defined by and between the flow mandrel and the concentric sleeve, the actuation chamber in fluid communication with the central flow passage through the at least one actuation port of the flow mandrel;

d. a collet lock disposed between the sleeve and the flow mandrel for releasably attaching the sleeve to the flow mandrel;

e. wherein the sleeve is moveable between a closed position, wherein the flow mandrel flow port is covered by the sleeve, and an open position wherein the sleeve does not close the flow mandrel flow port; and f. a return spring for biasing the sleeve into its closed position.

2. The recirculation valve of claim 1 wherein the collet lock comprises a plurality of collet fingers, wherein the collet lock is attached to either the sleeve or the mandrel and the collet fingers are releasably engaged in a groove formed in the sleeve or the mandrel.

3. The recirculation valve of claim 2, wherein the collet lock is attached to the sleeve and the collet fingers releasably engage a groove formed in the mandrel.

4. The recirculation valve of claim 1, wherein the sleeve defines at least one flow port which aligns with the flow mandrel flow port when the sleeve is in its open position.

5. The recirculation valve of claim 2 wherein the collet fingers are disposed within the actuation chamber.

6. The recirculation valve of claim 1 further comprising a stop ring disposed on the flow mandrel to limit downward travel of the sleeve.

7. The recirculation valve of claim 1 wherein a force required to open the valve by releasing the collet lock and overcoming the spring is provided by fluid pressure of greater than about 200 psi in the actuation chamber.

8. The recirculation valve of claim 7 wherein the opening force required is provided by fluid pressure between about 800 psi to about 1000 psi.

9. The recirculation valve of claim 7, wherein a maintenance force required to overcome the spring is provided by fluid pressure of less than about 100 psi in the actuation chamber.

10. The recirculation valve of claim 9, wherein the maintenance force is provided by fluid pressure of about 50 psi.

* * * * *